US006940498B2

(12) United States Patent
Park et al.

(10) Patent No.: US 6,940,498 B2
(45) Date of Patent: Sep. 6, 2005

(54) LIQUID CRYSTAL DISPLAY AND DRIVING METHOD THEREOF

(75) Inventors: Jong Jin Park, Seoul (KR); Ku Hyun Park, Anyang-shi (KR); Hyeon Ho Son, Anyang-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 225 days.

(21) Appl. No.: 10/025,906

(22) Filed: Dec. 26, 2001

(65) Prior Publication Data

US 2002/0084964 A1 Jul. 4, 2002

(30) Foreign Application Priority Data

Dec. 29, 2000 (KR) ..... P2000-85272

(51) Int. Cl.[7] ..... G09G 5/00
(52) U.S. Cl. ..... 345/204; 345/212
(58) Field of Search ..... 345/87, 90, 204, 345/205, 211, 212, 213, 214, 206, 690, 691, 692, 694, 696

(56) References Cited

U.S. PATENT DOCUMENTS 4,429,305 A * 1/1984 Hosokawa et al. ..... 345/90
5,162,786 A * 11/1992 Fukuda ..... 345/100
5,345,250 A * 9/1994 Inoue et al. ..... 345/100
5,412,397 A * 5/1995 Kanatani et al. ..... 345/99
6,014,122 A * 1/2000 Hashimoto ..... 345/98
6,104,364 A * 8/2000 Hayashi ..... 345/87
6,195,077 B1 * 2/2001 Gyouten et al. ..... 345/99
6,229,513 B1 * 5/2001 Nakano et al. ..... 345/99
6,232,949 B1 * 5/2001 Imamura ..... 345/100
6,262,704 B1 * 7/2001 Kurumisawa et al. ..... 345/98
6,496,174 B2 * 12/2002 Kurumisawa et al. ..... 345/98
6,515,647 B1 * 2/2003 Sakamoto ..... 345/99
6,525,710 B1 * 2/2003 Kwon ..... 345/100
6,559,433 B1 * 5/2003 Ozawa ..... 250/208.1
6,573,879 B2 * 6/2003 Taniguchi et al. ..... 345/60
6,628,259 B2 * 9/2003 Hashimoto ..... 345/98

* cited by examiner

*Primary Examiner*—Amare Mengistu
*Assistant Examiner*—Nitin Patel
(74) *Attorney, Agent, or Firm*—McKenna Long & Aldridge LLP

(57) ABSTRACT

This invention relates to a liquid crystal display and a driving method thereof, and more particularly to a liquid crystal display and a driving method thereof for improving a picture quality. The driving method of the liquid crystal display according to the present invention includes supplying a first scanning signal to a first gate line for driving a liquid crystal cell; supplying a second scanning signal to a second gate line which is formed while having at least one gate line between the first gate line and the second gate line after the first gate line scanning signal has been supplied; and supplying the data synchronized with the first scanning signal and the second scanning signal to a plurality of data lines formed in the manner of crossing with the plurality of the gate lines.

19 Claims, 10 Drawing Sheets

LIQUID CRYSTAL DISPLAY AND DRIVING METHOD THEREOF

This application claims the benefit of Korean Patent Application No. P2000-85272 filed Dec. 29, 2000, which is hereby incorporated by reference, as if fully set forth herein.

BACKGROUND OF THE INVENTION

1. Field of the Invention

This invention relates to a liquid crystal display and a driving method thereof, and more particularly to a liquid crystal display and a driving method thereof for improving a picture quality.

2. Description of the Related Art

Generally, an active matrix liquid crystal display device controls the light transmissivity of liquid crystal by the electric field applied to the liquid crystal, for displaying a picture. For this, the liquid crystal display device, as shown in FIG. 1, includes a liquid crystal display panel 2 in which a plurality of liquid crystal cells are arranged in a matrix between two transparent substrates, a gate driver 6 connected to a plurality of gate lines (GL1 to GLm) of the liquid crystal display panel 2, and a data driver 4 connected to a plurality of data lines (DL1 to DLn) of the liquid crystal display panel 2.

The gate driver 6 sequentially supplies scanning signals to m gate lines (GL1 to GLm) and drives a thin film transistor TFT connected to the corresponding gate lines (GL1 to GLm). The data driver 4 is synchronized with the scanning signals being sequentially supplied to the gate lines (GL1 to GLm) and supplies the data corresponding to a brightness value of video data to the data lines (Dl1 to DLn). In other words, the conventional liquid crystal display sequentially turns on/off for a frame period the whole gate lines (GL1 to GLm) formed in the liquid crystal panel 2 and supplies to the data lines (DL1 to DLn) the corresponding data to the gate lines (GL1 to GLm) for displaying the picture.

FIG. 2 is a diagram representing in detail a conventional gate driver.

Referring to FIG. 2, the conventional gate driver 6 includes a shift register 8 for receiving scan data from a supplier 14 and for shifting the supplied scan data, a level shifter 10 for receiving the scan data from the shift register 8 and for shifting a voltage level suitable for driving the liquid crystal display panel 2, and an outputter for receiving data from the level shifter 10 and for supplying to the liquid crystal display panel 2.

The supplier 14 supplies the scan data corresponding to '1' to a first bit of the shift register 8. The shift register 8 supplies the scan data corresponding to '1' supplied to a first bit in response to a clock signal (XGA, for example) (not shown), to a first bit of the level shifter 10 and a second bit of itself. The supplier 14 does not supply to the shift register 8 the scan data corresponding to '1' until the scan data corresponding to '1' is shifted to a $m^{th}$ bit of the shift register 8. In other words, there is only one scan data corresponding to '1' in the shift register 8.

Meanwhile, the shift register 8 sequentially moves to the m bit the scan data of '1' supplied to the first bit of itself, and supplies the scan data to each bit of the level shifter 10. When the scan data of '1' is supplied from the shift register 8, the level shifter 10 outputs a gate high volt (Ghv) to the outputter 12 by shifting the voltage level (around 20V). Also, when the scan data of '0' is supplied from the shift register 8, the level shifter 10 outputs a gate low volt (Glv) to the outputter 12 by shifting the voltage level (around −5V).

The outputter 12 supplies the scan data applied from the level shifter 10 to the liquid crystal display panel 2. If the scan data of '1' is currently supplied to a m−$10^{th}$ gate line (GLm-10), the liquid crystal display panel 2 is divided into the picture of a current frame 16 and the picture of a previous frame 18 on the basis of the m-$10^{th}$ gate line (GLm-10) as shown in FIG. 3.

Accordingly, if a moving picture which moves from right to left, is displayed in the liquid crystal display panel 2, the moving picture 20 displayed in the current frame 16 and the moving picture (22) displayed in the previous frame 18 appear to be crossing each other on the basis of the m-$10^{th}$ gate line (GLm-10) as shown in FIG. 4A. At this moment, the picture of the current frame and the picture of the previous frame overlap each other as much as the part 24 by which the moving picture 20 displayed in the current frame 16 moves, as shown in FIG. 4B. Thereby, a motion blur phenomenon occurs, resulting in the deterioration of the picture quality of the liquid crystal display panel 2.

In the meantime, a plurality of pixels on the liquid crystal panel 2 can be represented as an equivalent circuit shown in FIG. 5. In FIG. 5, a pixel includes a TFT connected with a gate line (GL), a data line (DL) and a common voltage line (CL), and a liquid crystal cell (Clc) connected with a drain terminal of the TFT and the reference voltage line (CL). Also, the pixel includes a parasitic capacitor (Cgs) formed between the drain terminal of the TFT and the gate line (GL), and a storage capacitor (Cst) between the parasitic capacitor (Cgs) and a ground voltage source (GND).

A data pulse is supplied to the data line (DL) when the gate high volt (Ghv) is supplied to the gate line (GL) of the liquid crystal display panel 2 as shown in FIG. 6. The voltage of the data pulse drops as much as the changed voltage (ΔVp) when the gate high volt (Ghv) is changed to a low state. As a result, the deterioration of the brightness of the liquid crystal display panel 2, that is, the deterioration of the picture quality of the liquid crystal display panel 2, occurs. The voltage drop amount (ΔVp) of the data pulse is determined by the following equation 1.

$$\Delta V_P = C_{gs}/C_{gs}+C_{st}+Clc(V_{gh}-V_{gL}) \qquad \text{EQUATION 1}$$

(wherein Clc is a capacitor of a liquid crystal cell, Vgh represents a voltage value of a gate high volt and Vgl represents a voltage value of a gate low volt.)

In the equation 1, a parasitic capacitor (Cgs), a storage capacitor (Cst), a voltage value of the gate high volt and a voltage value of the gate low volt are fixed, and the capacitor value of the liquid crystal cell (Clc) is determined by the picture displayed. If a still picture is displayed in the liquid crystal display panel 2, the capacitor value of the liquid crystal cell (Clc) can be predicted in advance. Accordingly, the voltage drop amount (ΔVp) of the data pulse can also be predicted so that the voltage drop amount (ΔVp) of the data pulse can be compensated.

However, if the moving picture is displayed in the liquid crystal display panel 2, the capacitor value of the liquid crystal cell (Clc) cannot be predicted in advance. Accordingly, the voltage drop amount (ΔVp) of the data pulse cannot be predicted. Accordingly, the voltage drop amount (ΔVp) of the data pulse is not compensated, thus the picture quality of the liquid crystal display panel 2 is deteriorated.

SUMMARY OF THE INVENTION

Accordingly, the present invention is directed to a liquid crystal display and driving method thereof that substantially obviates one or more of the problems due to limitations and disadvantages of the related art.

Accordingly, it is an advantage of the present invention to provide a liquid crystal display and a driving method thereof for improving a picture quality.

Additional features and advantages of the invention will be set forth in the description which follows, and in part will be apparent from the description, or may be learned by practice of the invention. Other advantages of the invention will be realized and attained by the structure particularly pointed out in the written description and claims hereof, as well as the appended drawings.

In order to achieve these and other advantages of the invention, a method of driving a liquid crystal display according to one aspect of the present invention includes the steps of supplying a first scanning signal to a first gate line positioned at a specific location among a plurality of gate lines for driving a liquid crystal cell; supplying a second scanning signal to a second gate line which is formed while having at least one gate line between said first gate line and said second gate line after said first gate line scanning signal has been supplied; and supplying the data synchronized with said first scanning signal and said second scanning signal to a plurality of data lines formed in the manner of crossing with the plurality of said gate lines.

In the method, said first scanning signal and said second scanning signal are sequentially supplied to the plurality of said gate lines.

The method further includes supplying picture data to the plurality of said data lines in synchronization with said first scanning signal; and supplying black data to the plurality of said data lines in synchronization with said second scanning signal.

The method further includes supplying picture data to the plurality of said data lines in synchronization with said second scanning signal; and supplying black data to the plurality of said data lines in synchronization with said first scanning signal.

A liquid crystal display according to another aspect of the present invention includes a liquid crystal display panel where a plurality of liquid crystal cells are arranged in a matrix type; a plurality of gate lines formed in said liquid crystal panel; a plurality of data lines formed in a manner of crossing with the plurality of said gate lines; a gate driver supplying a first scanning signal and a second scanning signal to the plurality of said gate lines; a scanning signal supplier supplying said first scanning signal and said second scanning signal to said gate driver; and a data driver supplying to the plurality of said data lines the data synchronized with said first scanning signal and said second scanning signal.

In the liquid crystal display, said first scanning signal and said second scanning signal are alternately and sequentially supplied.

In the liquid crystal display, said data driver supplies black data to said data line when said first scanning signal is supplied to one of said gate lines, and picture data is supplied when said second scanning signal is supplied to a gate line which is formed as having at least one gate line between itself and the gate line to which said first scanning signal is supplied.

In the liquid crystal display, said gate driver includes a first register sequentially for receiving said first scanning signal and said second scanning signal from said scanning signal supplier; a second register for receiving into an i (i is a natural number) bit of itself the data stored at the i bit of said first register and transmitting to i+1 bit of said first register the data stored at the i bit of itself; a level shifter for receiving the data that contain any one of said first scanning signal and said second scanning signal from said first register, and changing a voltage level suitable for driving said liquid crystal display panel; and an outputter for receiving from said level shifter the data of which the voltage level has been changed and for supplying to said liquid crystal display panel.

In the liquid crystal display, said scanning signal supplier supplies said second scanning signal to said first register when said first scanning signal is positioned at said second register.

In the liquid crystal display, said gate driver includes a first register sequentially receiving said first scanning signal and said second scanning signal from said scanning signal supplier; a second register receiving into an i (i is a natural number) bit of itself the data stored at the i bit of said first shift register and transmitting to i+1 bit of said first register the data stored at the i bit of itself; a level shifter receiving the data that contain any one of said first scanning signal and said second scanning signal from said second register, and changing a voltage level suitable for driving said liquid crystal display panel; and an outputter receiving from said level shifter the data of which the voltage level has been changed and supplying to said liquid crystal display panel.

In the liquid crystal display, said scanning signal supplier supplies said second scanning signal to said first register when said first scanning signal is positioned at said second register.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENT

Reference will now be made in detail to the embodiments of the present invention, examples of which are illustrated in the accompanying drawings.

With reference to FIGS. 7 to 12, embodiments of the present invention is explained as followings.

Figure 1:
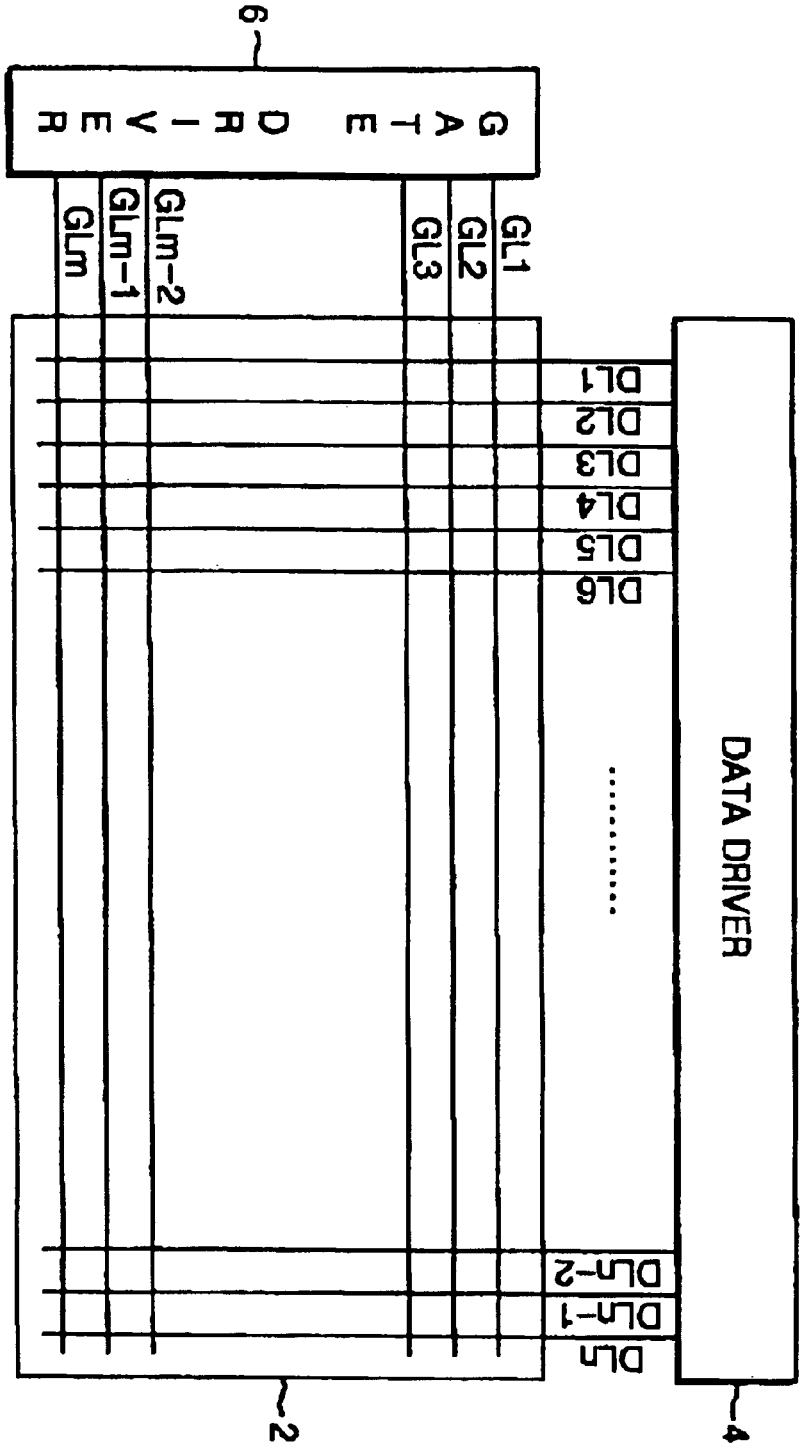
FIG.1 CONVENTIONAL ART
FIG. 1 schematically illustrates a conventional liquid crystal display device.
Figure 2:
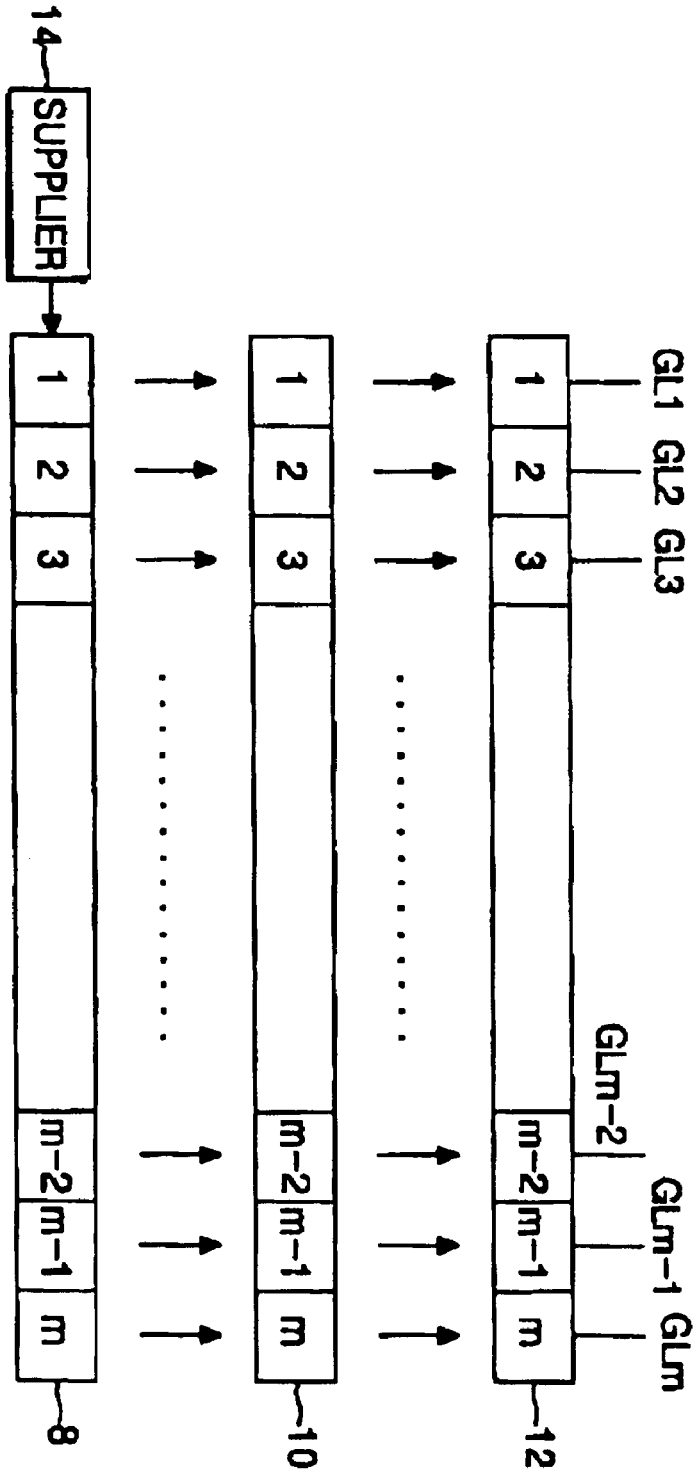
FIG.2 CONVENTIONAL ART
FIG. 2 illustrates a gate driver shown in FIG. 1.
Figure 3:
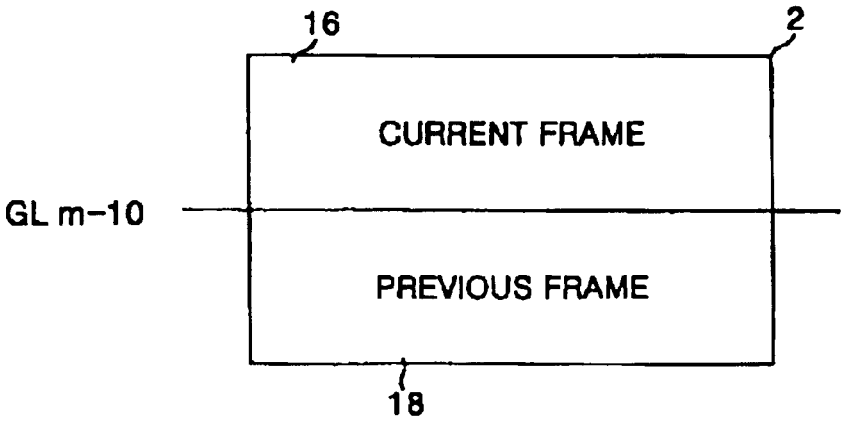
FIG.3 CONVENTIONAL ART
FIG. 3 represents a process of displaying a picture in the liquid crystal display panel shown in FIG. 1.
Figure 4A:
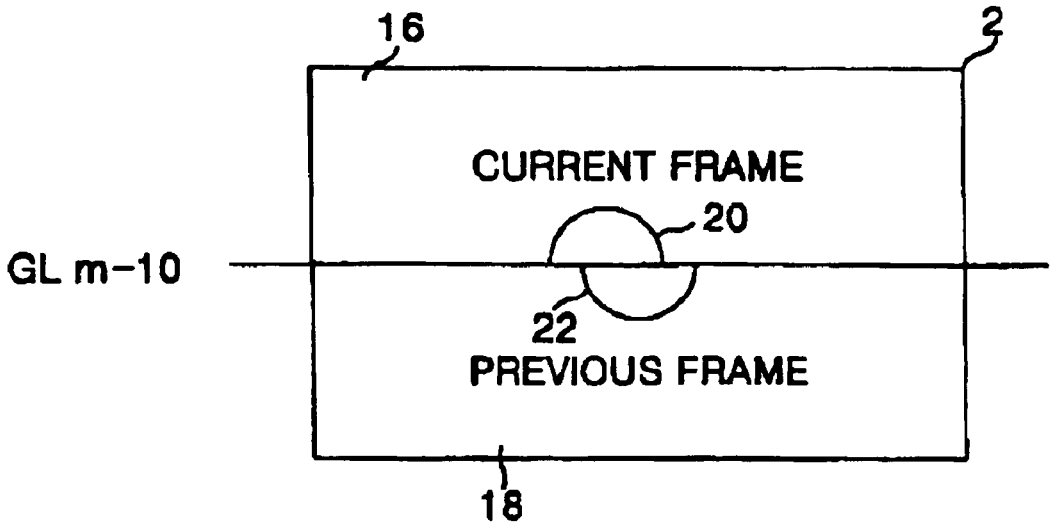
FIG.4A CONVENTIONAL ART
FIGS. 4A to 4B represent a process of displaying a moving picture in the liquid crystal display panel shown in FIG. 1.
Figure 4B:
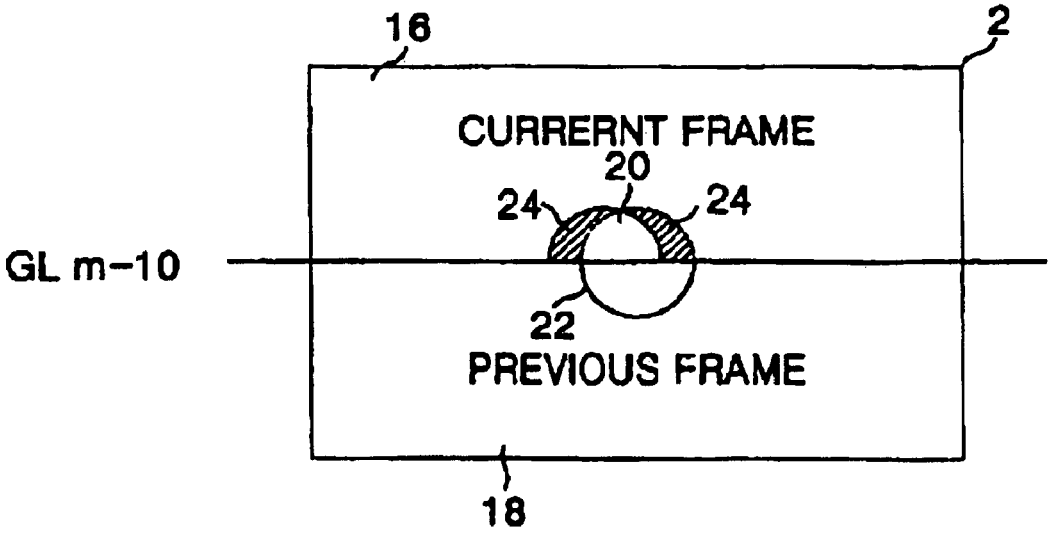
FIG.4B CONVENTIONAL ART
Figure 5:
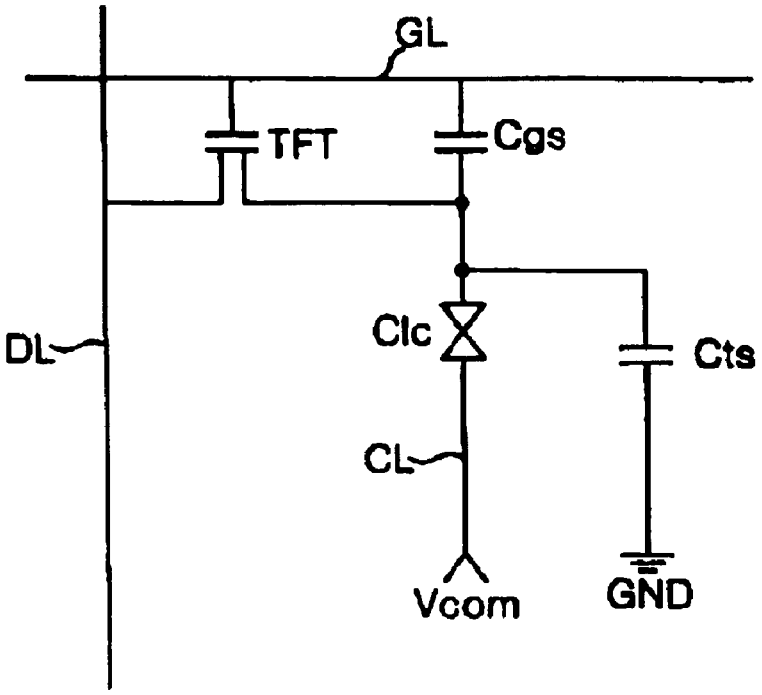
FIG.5 CONVENTIONAL ART
FIG. 5 is an equivalent circuit diagram of the liquid crystal display panel shown in FIG. 1.
Figure 6:
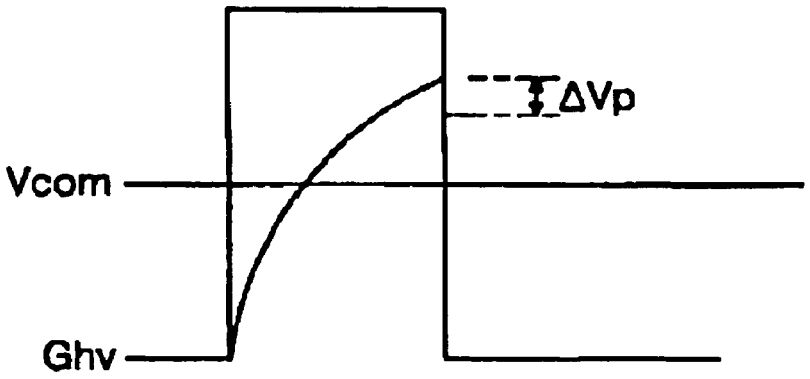
FIG.6 CONVENTIONAL ART
FIG. 6 represents a data pulse applied to a liquid crystal cell shown in FIG. 5.
Figure 7:
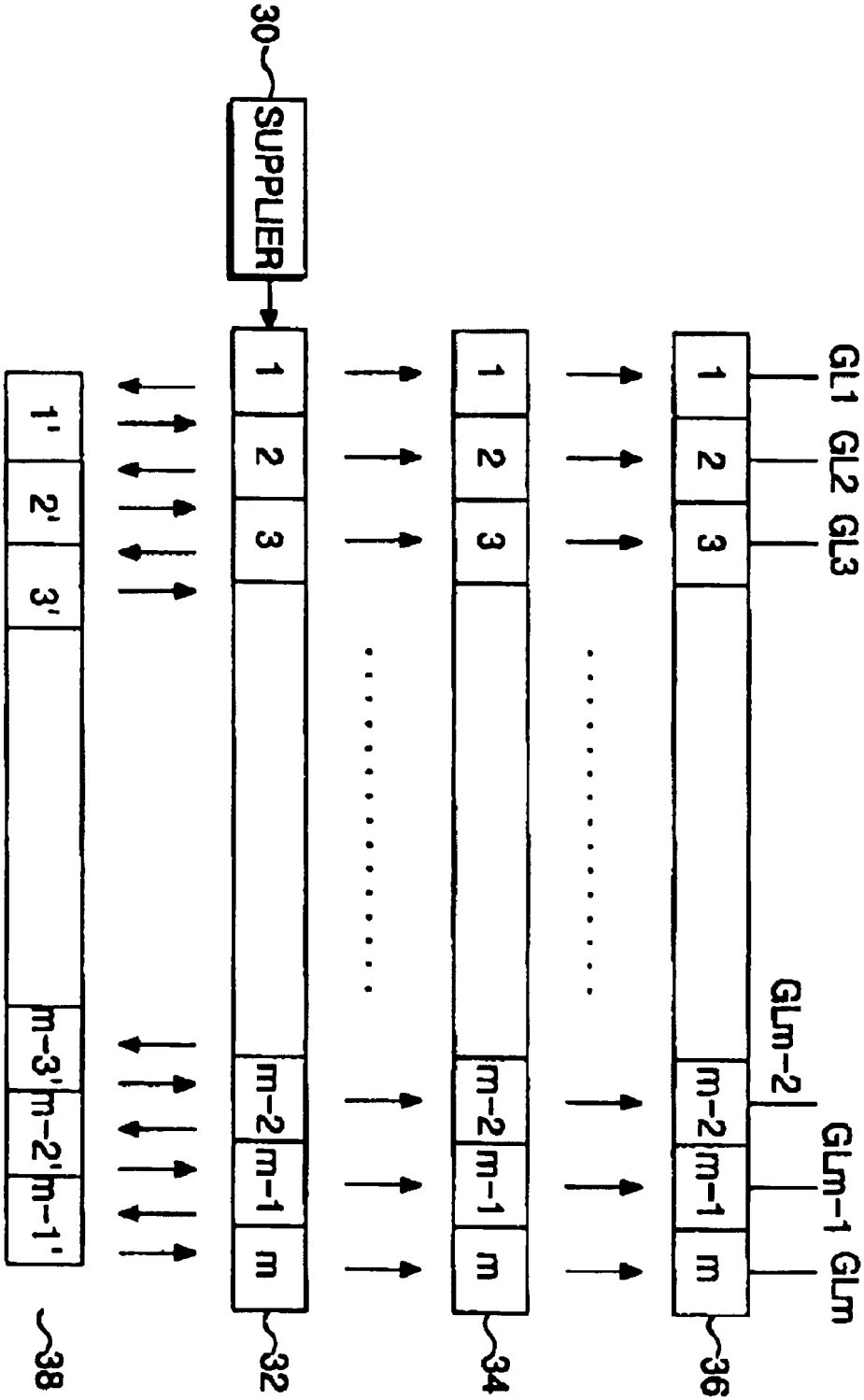
FIG. 7 illustrates a gate driver according to an embodiment of the present invention.

FIG. 7 particularly illustrates a gate driver according to an embodiment of the present invention.

Referring to FIG. 7, the gate driver according to the embodiment of the present invention includes a supplier 30 supplying scan data, a first register 32 receiving the scan data from the supplier 30, a second register 38 receiving the scan data from a $i^{th}$ bit of the first shift register 32 and supplying the scan data to a $i+1^{st}$ bit of the first register 32, a level shifter 34 receiving the scan data from the first register 32 and shifting a voltage level suitable for driving the liquid crystal display panel, and an outputter 36 receiving data from the level shifter 34 and supplying to the liquid crystal display panel.

To describe in detail the motion process of the gate driver, firstly, supplier 30 supplies a scan data corresponding to '1' to a first bit of the first register 32. Then the first register 32 supplies the provided scan data to a first bit of the level shifter 34 and a first bit of the second register 38.

The level shifter 34 supplies a gate high volt (Ghv) stored at the first bit of the level shifter 34 and corresponding to the scan data of '1' to a first bit of the outputter 36. Also, the level shifter 34 supplies a gate low volt (Glv) stored at the second through the $m^{th}$ bit of the level shifter 34 and corresponding to the scan data of '0' to the second through the $m^{th}$ bit of the outputter 36. After that, the outputter 36 supplies the gate high volt (Ghv) and the gate low volt (Glv) to the liquid crystal display panel.

Meanwhile, the second register 38 transmits to the second bit of the first register 32 the scan data supplied to the first bit of the second register 38. While having these processes repeated, the gate driver sequentially scans a plurality of gate lines (GL1 to GLm). In the meantime, the supplier 30 supplies the scan data of '1' to the first register 32 when the scan data of '1' is positioned at any bit of the second register 38.

For example, the supplier 30 supplies the scan data of '1' to the fist bit of the first register 32 when the scan data of '1' is positioned at a third bit of the second register 38. In this way, the gate high volt (Ghv) is supplied to the first gate line (GL1) when the scan data of '1' is supplied to the first bit of the first register 32.

After this, the scan data of '1' provided to the first bit of the first register 32 is transmitted to the first bit of the second register 38, and the scan data of '1' temporarily stored at the third bit of the second register 38 is transmitted to a fourth bit of the first register 32. Therefore, the gate high volt (Ghv) is supplied to a fourth gate line (GL4) after the gate high volt (Ghv) being supplied to the first gate line (GL1). In other words, two gate lines alternately receive the gate high volt (Ghv) in the present invention. For this, in the present invention, there is supplied to the gate driver the pulse signals (XGA, for example) having twice as high a frequency as in the conventional method.

Figure 8:
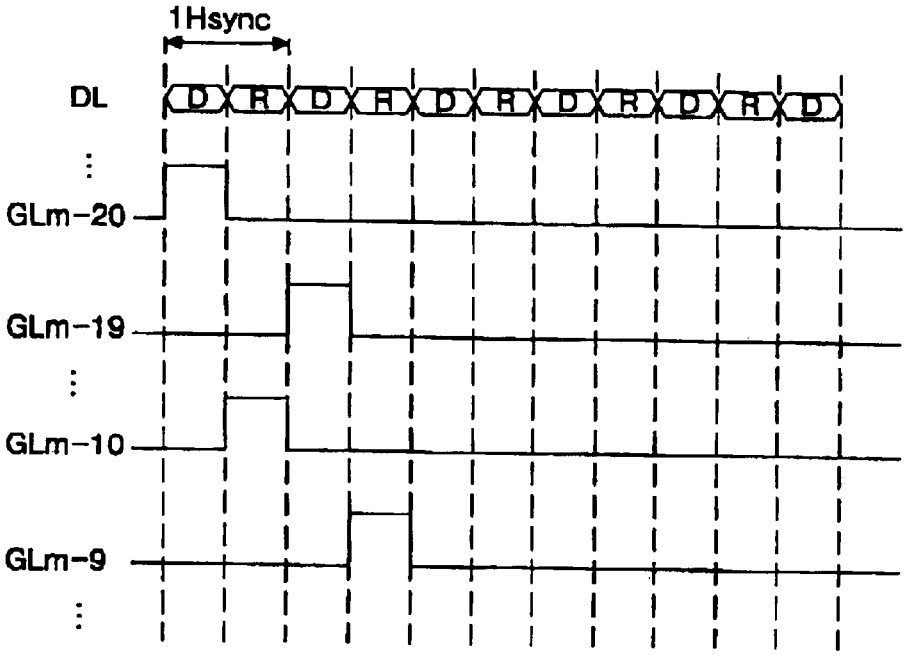
FIG. 8 is a waveform diagram representing a motion process of a data driver and a gate driver of the present invention.

Currently, if the scan data of '1' is alternately supplied to a m-$10^{th}$ the gate line (GLm-10) and a m-$20^{th}$ the gate line (GLm-20), as shown in FIG. 8, an actual data (D) and a reset data (R) are sequentially supplied to a plurality of data lines (DL) during 1 horizontal synchronization signal (Hsync). For this, in the present invention, there can be supplied to the data driver the pulse signals having twice as high a frequency as in the conventional way. The actual data (D) and the reset data (R) can be sequentially supplied because the data driver of the present invention additionally functions to output the reset data (R).

Figure 9:
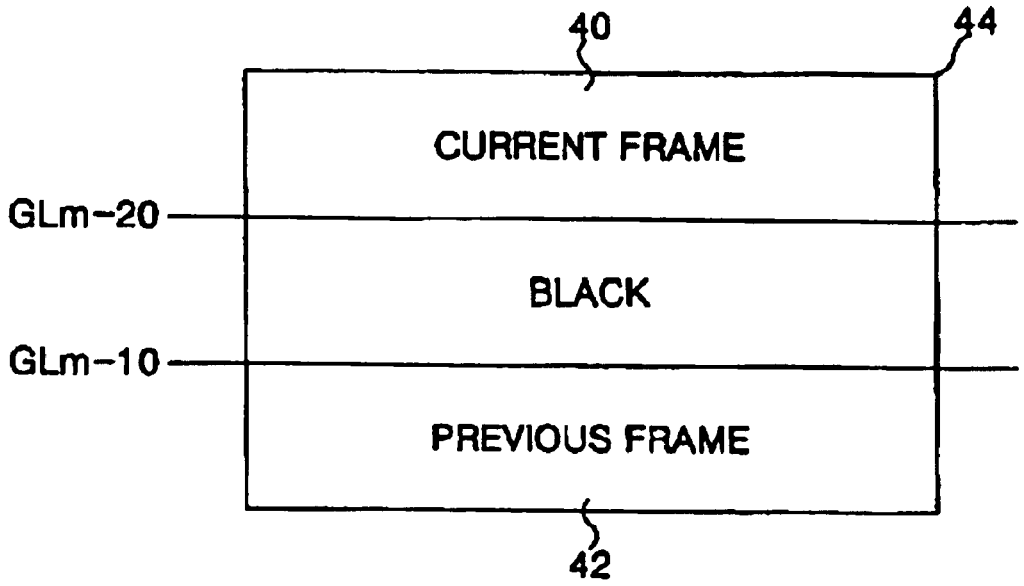
FIGS. 9 and 10 represent the process of displaying a picture in the liquid crystal display panel by the gate driver shown in FIG. 7.

A black screen is displayed between the m-$10^{th}$ gate line (GLm-10) and the m-$20^{th}$ gate line (GLm-20) in the liquid crystal display panel 44, as shown in FIG. 9, when the data driver and the gate driver are driven as shown in FIG. 8. In other words, when the scan data of '1' is supplied to the m-$20^{th}$ gate line (GLm-20), the actual data (D) to be displayed in the liquid crystal display panel 44 is supplied from the data driver. Also, the data driver supplies a black data, that is, the reset data (R), when the scan data of '1' is supplied to the m-$10^{th}$ gate line (GLm-10).

Figure 10:
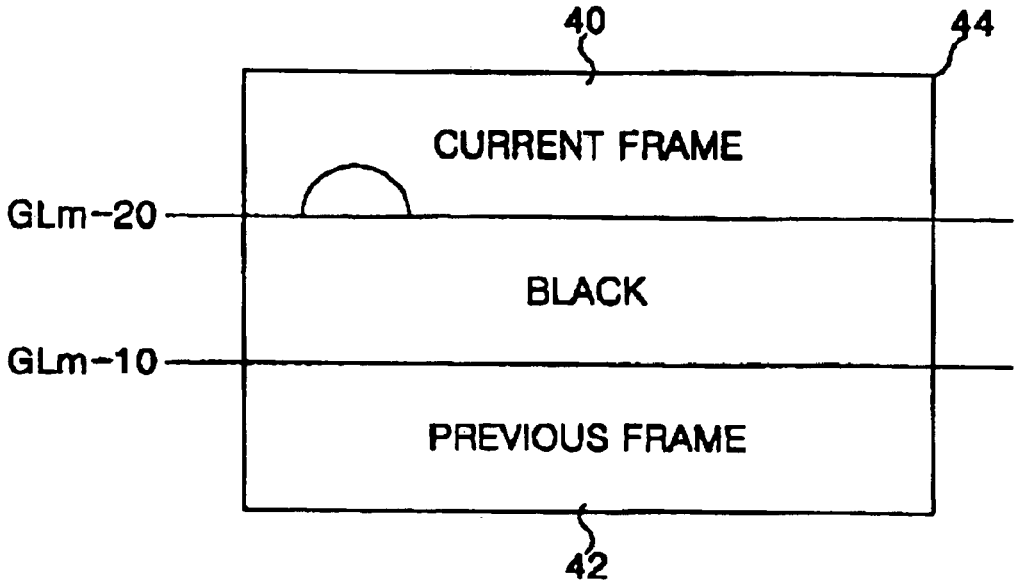
Figure 11:
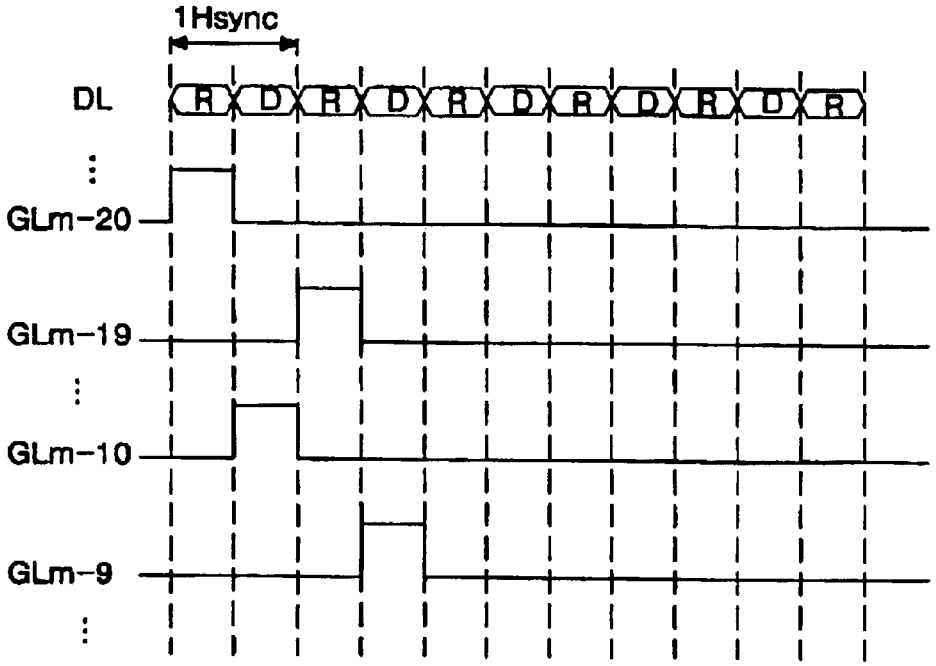
FIG. 11 is a waveform diagram representing a motion process of a data driver and a gate driver according to another embodiment of the present invention.

Accordingly, the picture to be displayed is displayed on top of the black picture in the liquid crystal display panel 44 as shown in FIG. 10. In other words, the picture to be displayed currently is displayed on top of the picture displayed previously in conventional method, but is always displayed on top of the black picture regardless of the previous picture in this invention. Thereby, there can be prevented the motion blurring phenomenon which occurs due to the overlap of the picture to be displayed currently and the picture displayed previously. Also, the value of the liquid crystal capacitor (Clc) of the equation 1 is always fixed in this invention. That is, because the picture to be displayed currently is always displayed on top of the black picture, the value of the liquid crystal capacitor (Clc) is always fixed to the value with which the black picture is displayed. Consequently, the voltage drop amount ($\Delta Vp$) can be predicted in advance so that the voltage drop amount ($\Delta Vp$) can be compensated.

Meanwhile, the reset data (R) is inputted when the m-$10^{th}$ gate line (GLm-10) being scanned and the actual data (D) is inputted when the m-$20^{th}$ gate line (GLm-20) being scanned in FIG. 8. But, as in FIG. 11, it is possible that the actual data (D) is inputted when the m$10^{th}$ gate line (GLm-10) being scanned and the reset data (R) is inputted when the m-$20^{th}$ gate line (GLm-20) being scanned. In other words, the scan data of '1' inputted first from the supplier 30 to the first register 32 has a picture data inputted, then the scan data of '1' inputted next from the supplier 30 to the first register 32 has a black data inputted. In the same manner, the scan data of '1' inputted first from the supplier 30 to the first register 32 has a black data inputted, then the scan data of '1' inputted next from the supplier 30 to the first register 32 has a picture data inputted.

Figure 12:
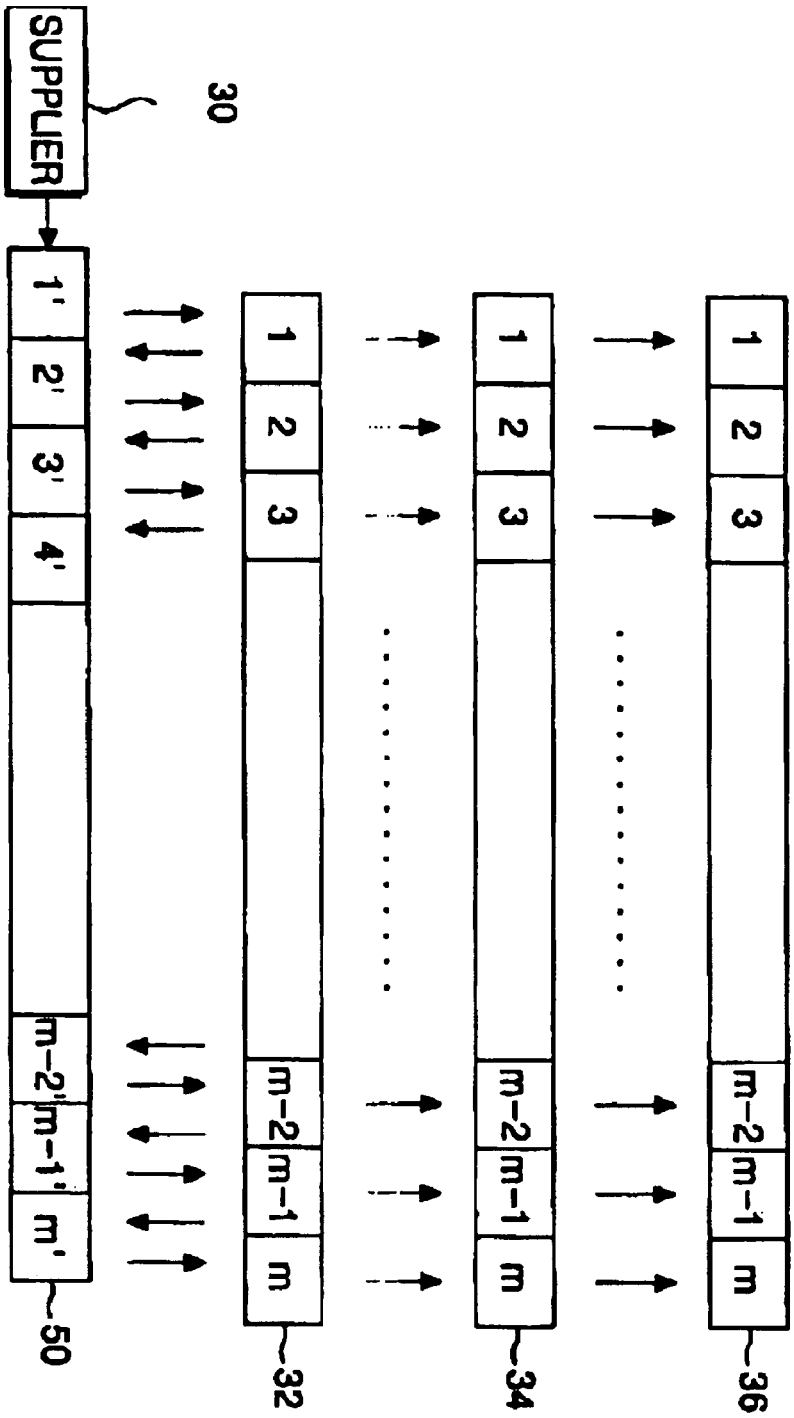
FIG. 12 particularly illustrates a gate driver according to still another embodiment of the present invention.

Also, the scan data can be inputted from the supplier 30 to the second register (50), as shown in FIG. 12, in the present invention. At this time, the first register 32 and the second register (50) have the same bit.

As in the foregoing description, in the liquid crystal display and the driving method thereof according to the present invention, two gate lines are alternately scanned in one frame, and black data is supplied when the first gate line is scanned and the picture data is supplied when the second gate line is scanned. Consequently, since the desired picture is displayed on top of the black picture in this invention, the motion blurring phenomenon can be prevented. Besides, the capacitor value of the liquid crystal can be predicted since the desired picture is displayed on top of the black picture.

That is, because the capacitor value of the liquid crystal is fixed, the voltage drop amount of the data pulse can be predicted, thereby the voltage drop amount of the data pulse can be compensated.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a liquid crystal display, comprising:

sequentially supplying a first scanning signal to consecutive ones of a plurality of gate lines;

sequentially supplying a second scanning signal to consecutive ones of the plurality of gate lines, wherein at least one gate line is between a gate line supplied with the first scanning signal and a gate line supplied with the second scanning signal; and supplying data synchronized with said first scanning signal and said second scanning signal to a plurality of data lines crossing with the plurality of gate lines.

2. The method according to claim 1, wherein said first scanning signal and said second scanning signal are alternately supplied to the plurality of gate lines.

3. The method according to claim 1, further comprising:

supplying picture data to the plurality of said data lines in synchronization with said first scanning signal; and supplying black data to the plurality of said data lines in synchronization with said second scanning signal.

4. The method according to claim 1, further comprising:

supplying picture data to the plurality of said data lines in synchronization with said second scanning signal; and supplying black data to the plurality of said data lines in synchronization with said first scanning signal.

5. A liquid crystal display, comprising:

a liquid crystal display panel wherein a plurality of liquid crystal cells are arranged in a matrix;

a plurality of gate lines in said liquid crystal display panel;

a plurality of data lines crossing with the plurality of said gate lines;

a gate driver sequentially scanning said plurality of gate lines, said scanning including sequentially supplying a first scanning signal and a second scanning signal to non-adjacent ones of the plurality of said gate lines;

a scanning signal supplier supplying said first scanning signal and said second scanning signal to said gate driver; and a data driver supplying data to the plurality of said data lines, wherein the supplied data is synchronized with said first scanning signal and said second scanning signal.

6. The liquid crystal display according to claim 5, wherein said gate driver alternately supplies the first scanning signal and said second scanning signal to said gate lines.

7. The liquid crystal display according to claim 5, wherein said data driver supplies black data to said data line when said first scanning signal is supplied to a first gate line; and picture data is supplied when said second scanning signal is supplied to a second gate line, at least one additional gate line between the second gate line and the first gate line.

8. The liquid crystal display according to claim 5, wherein said gate driver includes:

a first register sequentially receiving said first scanning signal and said second scanning signal from said scanning signal supplier;

a second register receiving into an i-bit thereof, wherein i is a natural number, the data stored at an i-bit of said first register and transmitting the stored data from the i bit of said second register to an i+1 bit of said first register;

a level shifter receiving the data that contain any one of said first scanning signal and said second scanning signal from said first register, and changing a voltage level suitable for driving said liquid crystal display panel; and an outputter receiving from said level shifter the data of which the voltage level has been changed and supplying to said liquid crystal display panel.

9. The liquid crystal display according to claim 8, wherein said scanning signal supplier supplies said second scanning signal to said first register when said first scanning signal is positioned at said second register.

10. The liquid crystal display according to claim 5, wherein said gate driver includes:

a first register sequentially receiving said first scanning signal and said second scanning signal from said scanning signal supplier;

a second shift register receiving into an i-bit thereof, wherein i is a natural number, the data stored at an i-bit of said first register and transmitting the stored data from the i bit of said second register to an i+1bit of said first register;

a level shifter receiving the data that contain any one of said first scanning signal and said second scanning signal from said second register, and changing a voltage level suitable for driving said liquid crystal display panel; and an outputter receiving from said level shifter the data of which the voltage level has been changed and supplying to said liquid crystal display panel.

11. The liquid crystal display according to claim 10, wherein said scanning signal supplier supplies said second scanning signal to said first register when said first scanning signal is positioned at said second register.

12. A method of driving a liquid crystal display, comprising:

providing a liquid crystal display panel having a plurality of liquid crystal cells arranged in a matrix;

forming a plurality of gate lines in said liquid crystal display panel;

forming a plurality of data lines crossing with said plurality of gate lines;

providing a scanning signal supplier supplying first and second scanning signals to a gate driver, said gate driver scanning said gate lines, said scanning including sequentially supplying said first scanning signal to adjacent ones of the plurality of gate lines and sequentially supplying said second scanning signal to adjacent ones of the plurality of gate lines such that at least one gate line is between a gate line supplied with said first scanning signal and a gate line supplied with the second scanning signal; and supplying data to the plurality of said data lines, wherein the supplied data is synchronized with said first and second scanning signals.

13. The method of driving a liquid crystal display according to claim 12, further comprising alternately supplying said first and second scanning signals to said gate lines.

14. The method of driving a liquid crystal display according to claim 12, further comprising:

using said data driver to supply a black data signal to said data line when said first scanning signal is supplied to one of said gate lines; and using said data driver to supply a picture data signal when said second scanning signal is supplied to a selected gate line, wherein at least one gate line is provided between said selected gate line and said gate line to which said first scanning signal is supplied.

15. The method of driving a liquid crystal display according to claim 12, further comprising:

sequentially receiving said first scanning signal and said second scanning signal from said scanning signal supplier into a first register;

receiving data stored at an $i^{th}$ bit of said first register, wherein i is a natural number, into an $i^{th}$ bit of a second register, and transmitting said received data into an $i^{th}+1$ bit of said first register;

receiving any one of said first scanning signal and said second scanning signal from said first register into a level shifter and selecting a voltage suitable for driving said liquid crystal display panel; and receiving said selected voltage from said level shifter into an outputter and supplying said selected voltage to said liquid display panel.

16. The method of driving a liquid crystal display according to claim 15, wherein said second scanning signal is supplied to said first register when said first scanning signal is positioned at said second register.

17. The method of driving a liquid crystal display according to claim 12, further comprising:

sequentially receiving said first scanning signal and said second scanning signal from said scanning signal supplier into a first register;

receiving data stored at an $i^{th}$ bit of said first register, wherein i is a natural number, into an $i^{th}$ bit of a second register, and transmitting said received data into an $i^{th}+1$ bit of said first register;

receiving any one of said first scanning signal and said second scanning signal from said second register into a level shifter and selecting a voltage suitable for driving said liquid crystal display panel; and receiving said selected voltage from said level shifter into an outputter and supplying said selected voltage to said liquid display panel.

18. The method of driving a liquid crystal display according to claim 17, wherein said second scanning signal is supplied to said first register when said first scanning signal is positioned at said second register.

19. A method of driving a liquid crystal display, comprising:

sequentially supplying first and second scanning signals to a plurality of consecutively arranged gate lines in a liquid crystal panel having a plurality of liquid crystal cells arranged in a matrix, wherein at least one gate line is between a gate line supplied with the first scanning signal and a gate line supplied with the second scanning signal; and supplying data signals to a plurality of data lines, wherein the data signals are synchronized with the first and second scanning signals, and wherein the data lines intersect the gate lines.

* * * * *